United States Patent [19]

Takahashi et al.

[11] 4,298,033

[45] Nov. 3, 1981

[54] WEFT TENSIONING DEVICE

[75] Inventors: Kihei Takahashi; Seiko Terada, both of Uozu; Kiyoshi Nakada, Nyuzen, all of Japan

[73] Assignee: Yoshida Kogyo, K.K., Japan

[21] Appl. No.: 58,209

[22] Filed: Jul. 17, 1979

[30] Foreign Application Priority Data

Jul. 18, 1978 [JP] Japan ..... 53-87978

[51] Int. Cl.[3] ..... D03D 47/34

[52] U.S. Cl. ..... 139/450; 139/452

[58] Field of Search ..... 139/450, 452, 442; 66/132 R

[56] References Cited

U.S. PATENT DOCUMENTS

| | | | |
|---|---|---|---|
| 3,330,304 | 7/1967 | Hall | 139/452 |
| 3,460,584 | 8/1969 | Mosher | 139/452 |
| 3,561,499 | 2/1971 | Hortmann | 139/452 |

FOREIGN PATENT DOCUMENTS

| | | | |
|---|---|---|---|
| 234607 | of 1964 | Austria | 139/452 |
| 583219 | 12/1977 | U.S.S.R. | 139/452 |

*Primary Examiner*—Henry Jaudon

*Attorney, Agent, or Firm*—Robert E. Burns; Emmanuel J. Lobato; Bruce L. Adams

[57] ABSTRACT

A weft tensioning device in a shuttleless loom includes a weft yarn feeder and a tension compensator interposed between the weft yarn feeder and a filling carrier. The tension compensator has a pair of weft guides and means disposed between the weft guides for intermittently shifting the weft yarn sideways off a path between the weft guides in response to reciprocation of the filling carrier. The weft yarn feeder has weft yarn winding means, the diameter of which is variable to meet different yarn demands for various widths of narrow fabric to be produced or to compensate for varying yarn stretchability due to different degrees of ambient temperature and humidity.

8 Claims, 13 Drawing Figures

WEFT TENSIONING DEVICE

BACKGROUND OF THE INVENTION

1. Field of the Invention

The present invention relates to a weft tensioning device for use on shuttleless looms such as needle looms.

2. Prior Art

Needle looms use a reciprocating weft inserter or filling carrier to place a filling into a warp shed and to be withdrawn out of the warp shed during the crossing of the warps for a new shed. Such movement of the filling carrier for intermittent utilization of weft, that is, a sudden use of weft followed by a period of no use, results in maximum weft tension followed by a slackening of the weft. It is therefore necessary to maintain a constant tension of the weft in the vicinity of the filling carrier during the operation of the loom so as to keep evenness of the fabric being woven.

One proposal for constant weft tension has been a spring located between the weft yarn feeder and the filling carrier to take up slack in the weft. However, the spring cannot be responsive to high-speed operation of the filling carrier, thereby putting a sudden high strain on the weft. While the filling carrier is being reciprocated at high speeds, the weft can be broken, the eye in the filling carrier for the passage of the weft can be worn away soon, and the selvage knitting needle can be damaged.

SUMMARY OF THE INVENTION

It is an object of the present invention to provide a weft tensioning device for keeping a weft yarn under constant tension during high-speed operation of a filling carrier.

According to the present invention, a weft tensioning device comprises a weft yarn feeder rotatable in synchronism with the operation of a reciprocable filling carrier for supplying a weft yarn to the filling carrier of a needle loom, and a weft tension compensator disposed between the weft yarn feeder and the filling carrier. The weft yarn feeder has weft winding means having a variable diameter for advancing the weft yarn at different rates at the same speed of rotation of the weft yarn feeder. The tension compensator includes a pair of weft guides for carrying the weft yarn along a substantially straight path therebetween and slack takeup means disposed between the weft guides and actuatable in synchronism with the operation of the weft yarn feeder for intermittently shifting sideways the weft yarn off the path.

BRIEF DESCRIPTION OF THE DRAWINGS

The above and other objects, features and advantages of the present invention will become apparent from the following description when taken in conjunction with the accompanying drawings, in which.

DESCRIPTION OF THE PREFERRED EMBODIMENTS

Figure 1:
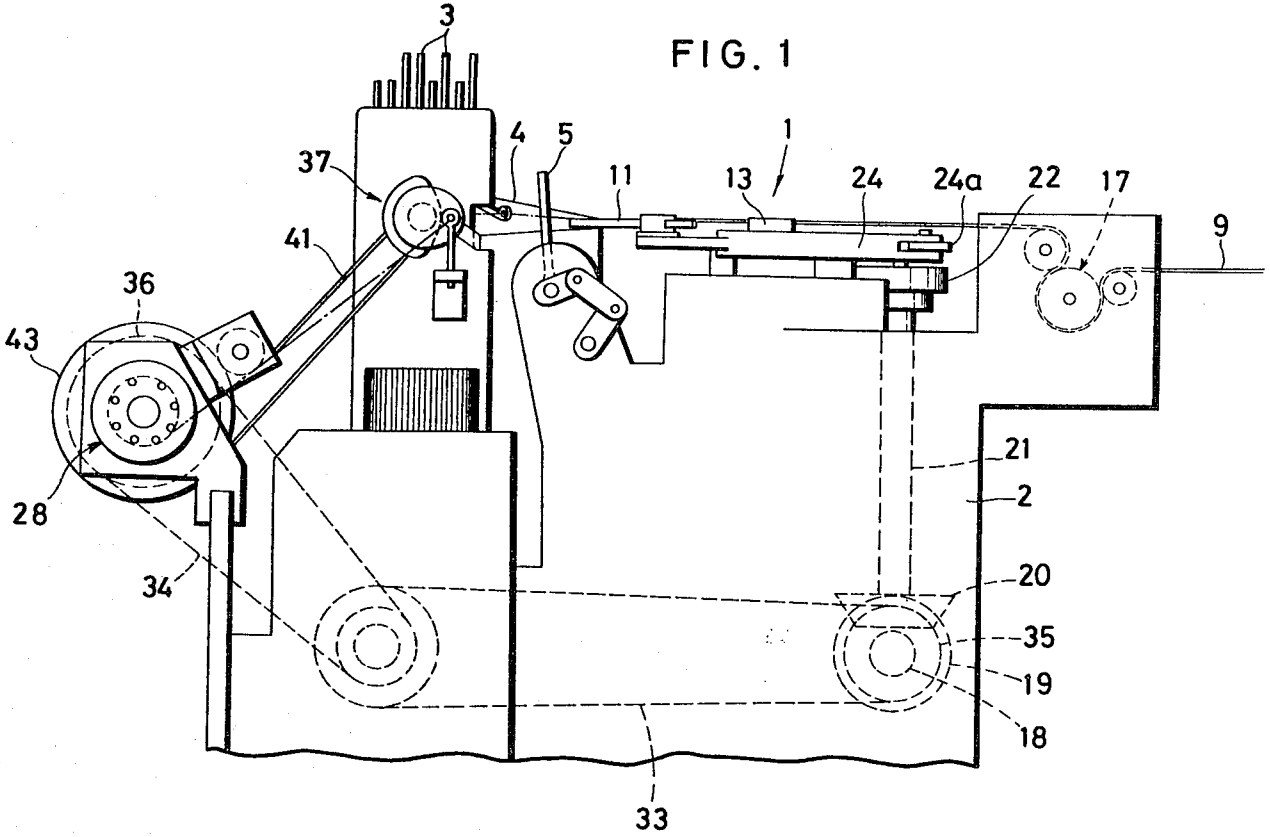
FIG. 1 is a front elevation view of a needle loom to which a weft tensioning device according to the present invention is applied.
Figure 2:
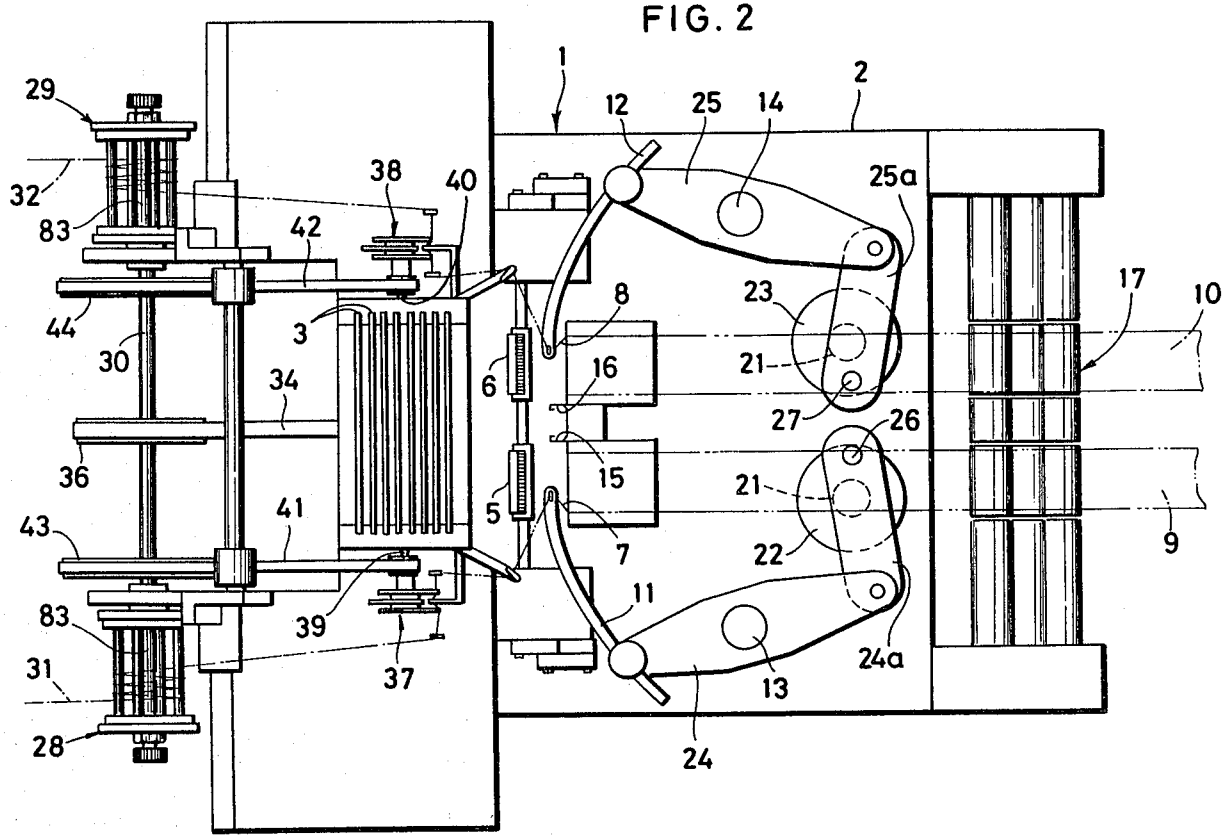
FIG. 2 is a plan view of the needle loom of FIG. 1.

In FIGS. 1 and 2, a needle loom 1 generally comprises a frame 2, a plurality of heedles 3 mounted on the frame 2 for separating two groups of warp threads 4 to form warp sheds successively, a pair of beat-up reeds 5,6 pivotable back and forth to beat up inserted fillings 7,8 against the fells of narrow fabrics 9, 10 being produced, a pair of filling carriers 11,12 pivotally mounted on a pair of shafts 13,14, respectively, on the frame 2 for placing fillings 7,8 across the warp sheds, and a pair of selvage-forming latch needles 15,16 reciprocable alongside of the fabrics 9,10 for catching and knitting loops of fillings 7,8 with previous filling loops. The narrow fabrics 9,10 as they are produced are discharged by a set of discharge rolls 17.

A main shaft 18 which is supported in the frame 2 and is drivable by a motor (not shown) is operatively coupled via bevel gears 19,20 with vertical shafts 21 having on their upper ends crank discs 22,23. The filling carriers 11,12 are mounted on a pair of arms 24,25, respectively, pivotally connected to a pair of links *24a,25a*, which are coupled to a pair of eccentric pins 26,27 on the crank discs 22,23, respectively.

A pair of weft yarn feeders 28,29 are mounted on a drive shaft 30 rotatably supported on the frame 2. The weft yarn feeders 28,29 carry these around windings of weft yarns 31,32, respectively, and feed the weft yarns 31,32 upon rotation thereof to the filling carriers 11,12 respectively. The weft yarn feeders 28,29 are driven synchronously with the filling carriers 11,12 through a train of belts 33, 34 runnning around pulleys 35,36 on the main shaft 18 and the drive shaft 30, respectively.

A pair of tension compensators 37,38 are disposed respectively in paths of the weft yarns 31,32 between the weft yarn feeder 28 and the filling carrier 11, and between the weft yarn feeder 29 and the filling carrier 12, respectively. The tension compensators 37,38 are rotatably supported on a pair of rods 39,40, respectively, mounted on the frame 2. The tension compensators 37,38 are driven in synchronism with the rotation of the weft yarn feeders 28,29 by a pair of belts 41,42 running around a pair of pulleys 43, 44 fixed to the drive shaft 30.

Figure 3:
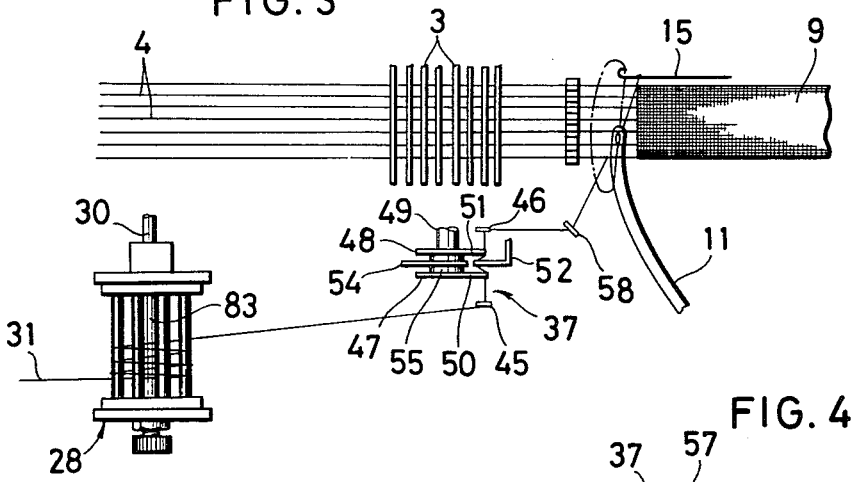
FIG. 3 is a schematic plan view of a needle loom of the present invention.
Figure 4:
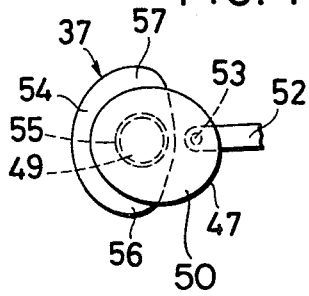
FIG. 4 is an enlarged front elevation view of a tension compensator.

Since the tension compensators 37, 38 are the mirror images of each other, the structure of one of the tension compensators 37 will be described. As shown in FIGS. 3 and 4, the tension compensator 37 comprises a pair of weft guides 45, 46 for carrying the weft yarn 31 along a substantially straight path therebetween, and a pair of eccentric plate cams 47, 48 mounted on an axle 49 which is rotatable on the rods 39 by the belt 41. The plate cams 47, 48 are aligned axially with each other and are corotatable in planes between the weft guides 45, 46 and substantially perpendicular to the path of the weft yarn 31 between the weft guides 45, 46. The cams 47, 48 have portions 50, 51, respectively, movable across and retractable from the path of the weft yarn 31 between the weft guides 45, 46 in response to the rotation of the cams 47, 48.

A yarn guide 52 having an eye 53 is fixed to the frame 2. The eye 53 is located between the weft guides 45, 46 for carrying therethrough the weft yarn 31. When the portions 50, 51 of the cams 47, 48 are disposed across the path of the weft yarn 31, the eye 53 is interposed between the cam portions 50, 51.

A yarn stop 54 in the form of a plate is fixed to the frame 2 by means of an arm (not shown). The yarn stop 54 is secured to a sleeve 55 fitted slidably over a portion of the axle 49 which lies between the cams 47,48. The yarn stop 54 has a pair of wings 56, 57 projecting radially outwardly of the axle 49.

The weft yarn 31 is fed by the weft yarn feeder 28 through the weft guides 45, 46 and through a yarn guide 58 to the filling carrier 11.

The tension compensator 37 rotates in timed relation with the reciprocation of the filling carrier 11, such that when the filling carrier 11 starts being retracted from its fully inserted position across a warp shed, the cam portions 50, 51 begin to move across the weft path between the weft guides 45, 46 and hence to engage and displace the weft yarn 31 sideways off the path away from the axle 49. Therefore, a slack which develops in the weft yarn 31 during the returning movement of the filling carrier 11 is removed. As the filling carrier 11 starts to move into a warp shed, the cam portions 50, 51 start to depart the path of the weft yarn 31 between the weft guides 45, 46. The weft yarn 31 is thus maintained under substantially constant tension during the reciprocating movement of the filling carrier 11. Since the tension compensator 37 is synchronized mechanically with the filling carrier 11, the tension compensator 37 is responsive to high-speed operation of the filling carrier 11.

Figure 5:
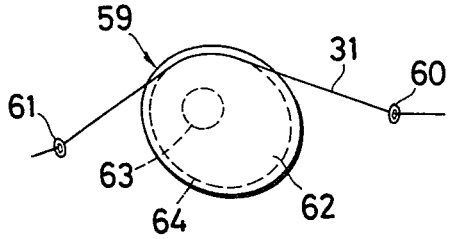
FIG. 5 is an enlarged side elevation view of another embodiment of the tension compensator.

The wings 56, 57 of the yarn stop 54 prevent the weft yarn 31 from moving along with the cam portions 50, 51 and being entangled with the cams 47, 48 and around the axle 49. FIG. 5 shows another embodiment of the tension compensator 59, which comprises a pair of weft guides 60, 61 and an eccentric plate cam 62 disposed between the weft guides 60, 61. The cam 62 is rotatable on an axle 63 driven by the belt 41 in a plane substantially parallel to a path of the weft yarn 31 between the weft guides 60, 61. The cam 62 has a peripheral groove 64 for receiving the weft yarn 31 therein. The rotation of the cam 62 periodically shifts the weft yarn 31 sideways off the path thereof so as to remove a slack out of the weft yarn 31.

Figure 6:
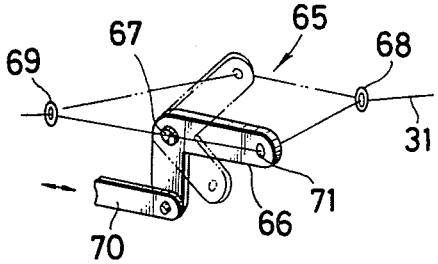
FIG. 6 is an enlarged perspective view of an embodiment of the tension compensator.

According to another tension compensator 65 shown in FIG. 6, a crank lever 66 pivotable on a fixed pin 67 is disposed between a pair of weft guides 68, 69. The crank lever 66 has one end pivotally connected to a lever 70 reciprocally movable back and forth by a suitable mechanism driven by the belt 41. The other end of the crank lever 66 has an eye 71 through which the weft yarn 31 extends. The weft yarn 31 is intermittently displaced sideways off the path between the weft guides 68, 69 by the reciprocation of the lever 70.

Figure 7:
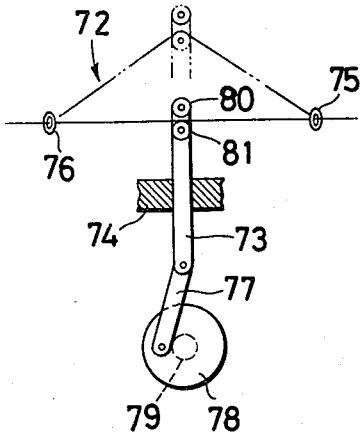
FIG. 7 is an enlarged front elevation view of another embodiment of the tension compensator.

In FIG. 7, a tension compensator 72 according to still another embodiment has a lever 73 slidably supported in a support 74 on the frame 2 and disposed between a pair of weft guides 75, 76. The lever 73 is pivotally connected at one end to a link 77 which is pivotally mounted at an eccentric position on a disk 78 rotatable on an axle 79 driven by the belt 41. The lever 73 has at the other end a pair of spaced rolles 80, 81 for carrying the weft yarn 31 therebetween. The lever 73 reciprocates substantially perpendicularly to a path of the weft yarn 31 between the weft guides 75, 76 in response to the rotation of the disc 78, whereupon the rolls 80, 81 shift the weft yarn 31 sideways off the path between the weft guides 75, 76.

The weft yarn feeder 29 is the mirror image of the weft yarn feeder 28, and the structural details and operation of the weft yarn feeder 28 will be described.

Figure 8:
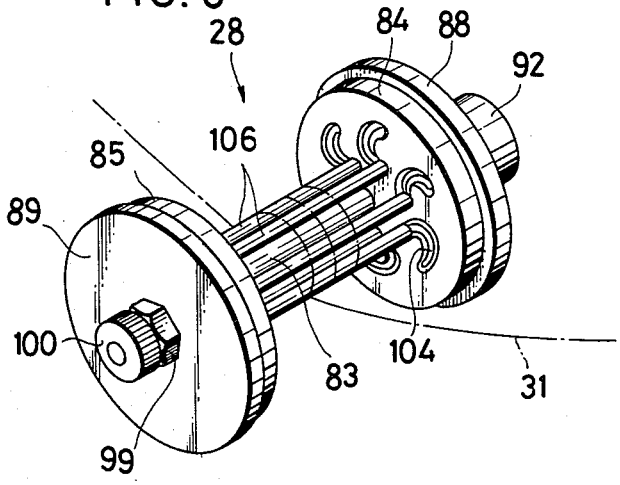
FIG. 8 is an enlarged perspective view of a weft yarn feeder.
Figure 9:
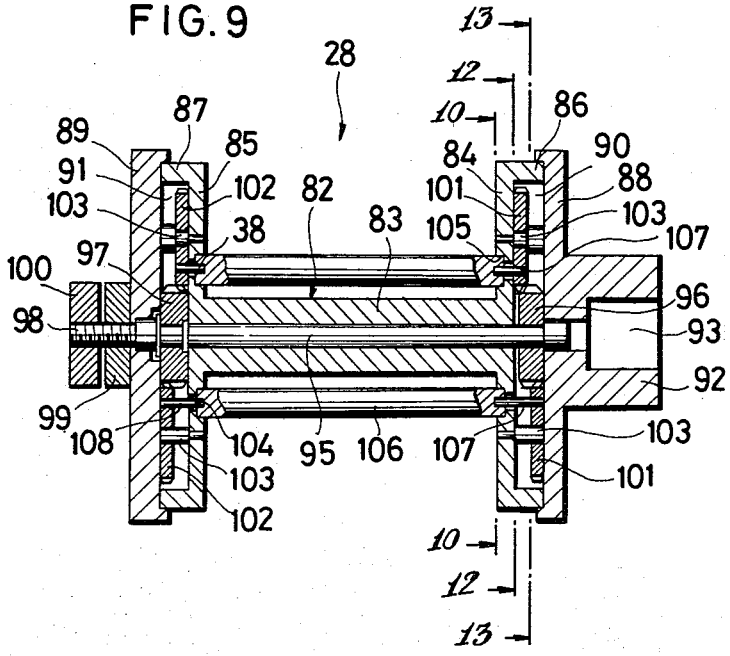
FIG. 9 is a longitudinal cross section view of the wef yarn feeder of FIG. 8.

As best shown in FIGS. 8 and 9, the weft yarn feeder 28 comprises a spool 82 including a hollow shaft 83 and a pair of circular flanges 84, 85 on the ends of the hollow shaft 83. The circular flanges 84, 85 have a pair of annular flanges or rims 86, 87, respectively projecting axially away from each other. A pair of circular covers 88, 89 are mounted on the rims 86, 87, respectively. A pair of gear chambers 90, 91 are provided between the flange 84 and the cover 88 and between the flange 85 and the cover 89, respectively.

The cover 88 has an axial attachment projection 92 having an axial recess 93 for lockingly receiving the drive shaft 30 (FIG. 2) that is rotatable about its own axis at a constant rate of speed.

A spindle 95 extends axially through the hollow shaft 83 and is rotatably supported by the covers 88, 89. A pair of axially spaced drive gears 96, 97 are fixed to the spindle 95 and are located in the gear chambers 90, 91, respectively, at the ends of the spool 82. The spindle 95 has an externally threaded end portion 98 projecting beyond the cover 89. A fastening nut 99 is threaded over the threaded end portion 98, a peripherally knurled knob 100 is fixed to the threaded end portion 98. The spindle 95 can be turned about its own axis by turning the knob 100 by hand, and can be nonrotatably held in position relatively to the cover 89 by tightening the fastening nut 99 against the cover 89.

Figure 13:
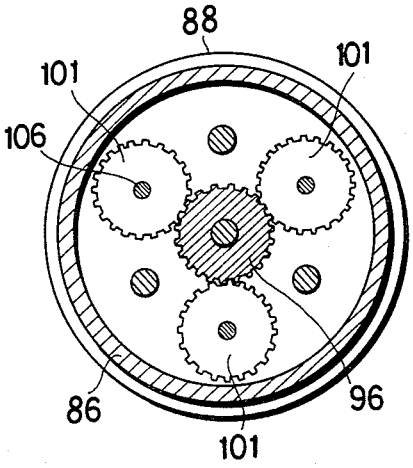
FIG. 13 is a cross section view taken along section line 13—13 of FIG. 9.

In each of the gear chambers 90, 91, a plurality of driven gears 101 or 102 (six in number in the illustrated embodiment) are rotatably supported on pins 103 mounted on the flange 84 or 85 and the cover 88 or 89. The pins 103 are angularly spaced from each other and are located around the drive gears 96, 97. The drive gears 96, 97 are held in driving mesh with the driven gears 101, 102, respectively. Each of the driven gears 101 in the gear chamber 90 is paired with and held in axial alignment with one of the driven gears 102 in the gear chamber 91. Adjacent ones of the driven gears 101 or 102 in the gear chambers 90 or 91 are axially displaced from each other so as to prevent any interference or contact therebetween, as shown in FIG. 13.

Figure 10:
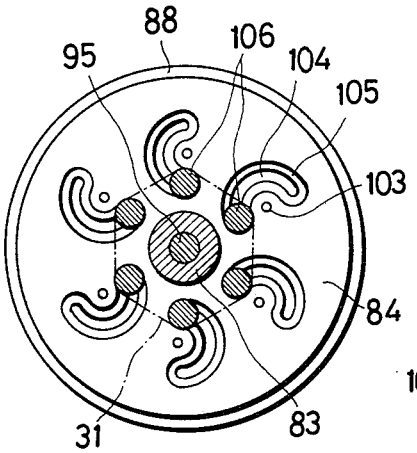
FIG. 10 is a cross section view taken along section line 10—10 of FIG. 9.
Figure 11:
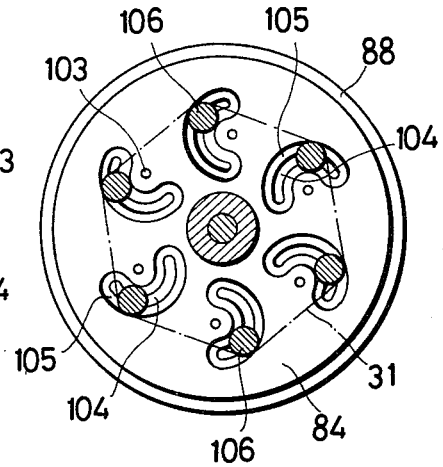
FIG. 11 is a view similar to FIG. 10, showing yarn rods displaced radially outwardly.
Figure 12:
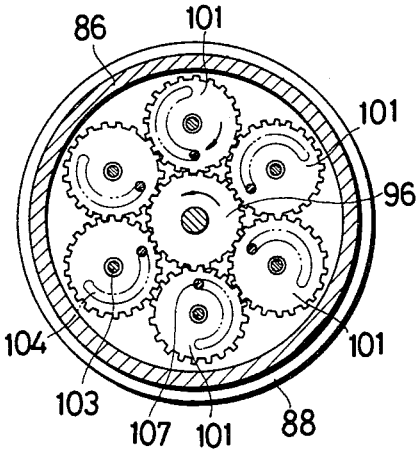
FIG. 12 is a cross section view taken along section line 12—12 of FIG. 9.

As best illustrated in FIGS. 10 and 11, each of the flanges 84, 85 has a plurality of arcuate guide slots 104 angularly spaced equal distances from each other and extending generally radially of the hollow shaft 83. Each of the arcuate guide slots 104 extends substantially halfway about one of the pins 103. Each guide slot 104 includes a recessed shoulder 105 extending therealong. The arcuate guide slots 104 in the flange 84 are axially aligned with the arcuate guide slots 104 in the flange 85 and are paired therewith.

A plurality of yarn rods 106 of circular cross section extend axially along and are disposed radially around the hollow shaft 83. Each of the yarn rods 106 has a pair of end portions connected to a pair of the driven gears 101, 102 through a pair of pins 107, 108 connected eccentrically to the pair of the driven gears 101, 102, respectively, and extending loosely through a pair of the slots 104, 104 in the flanges 84, 85, respectively. The end portions of each yarn rod 106 are slidably received on a pair of the recessed shoulders 105, 105 in the flange 84, 85.

The weft yarn 31 is wound around the yarn rods 106 jointly forming a cylinder-like configuration. The weft yarn 31 is positively fed along by rotation of the yarn feeder 28 about its own axis at a constant speed.

When it is necessary to change the rate of feed of the weft yarn 31, the knob 100 is rotated to turn the spindle 95. The drive gears 96, 97 are simultaneously rotated with the spindle 95 to cause the driven gears 101, 102 to be turned on the pins 103. The pins 107, 108 are then moved along the slots 104, whereupon the yarn rods 106 move radially outwardly or inwardly (FIGS. 10 and 11). Accordingly, the diameter of the cylinder-like configuration defined jointly by the yarn rods 106 and around which the weft yarn 31 is to be wound is changed to provide a different rate of feed of the weft yarn 31 while the weft yarn feeder 28 is being rotated at the same speed.

Since the yarn rods 106 are supported and driven at both ends, they move smoothly and uniformly in a radial direction in response to the rotation of the driven gears 101, 102. Such radial movement of the yarn rods 106 can be effected gradually with fine adjustment by the rotation of the knob 100.

Although a preferred embodiment has been shown and described in detail, it should be understood that various changes and modifications can be made therein without departing from the scope of the appended claims.

What is claimed is:

1. In a loom having a reciprocable filling carrier, a weft tensioning device comprising:

(a) a weft yarn feeder rotatable in synchronism with the reciprocation of the filling carrier for supplying a weft yarn to the filling carrier, said weft yarn feeder including weft winding means having a variable diameter for advancing the weft yarn at different rates at the same speed of rotation of the weft yarn feeder; and (b) a tension compensator disposed between said weft yarn feeder and the filling carrier, said tension compensator including a pair of weft guides for carrying the weft yarn along a substantially straight path therebetween and stack takeup means disposed between said pair of weft guides and actuatable in synchronism with the operation of said weft yarn feeder for intermittently shifting sideways the weft yarn off said path, said slack takeup means comprising a pair of eccentric plate cams corotable in planes substantially perpendicular to said path in response to the rotation of said weft yarn feeder, said cams having portions movable across and retractable from said path in response to the rotation of said cams, and a yarn guide fixedly disposed between said cams for carrying the weft yarn in said path.

2. A weft tensioning device according to claim 1, said slack takeup means including a yarn stop fixedly disposed between said cams for preventing the weft yarn from moving along with said portions of the cams.

3. In a loom having a reciprocable filling carrier, a weft tensioning device comprising:

(a) a weft yarn feeder rotatable in synchronism with the reciprocation of the filling carrier for supplying a weft yarn to the filling carrier, said weft yarn feeder including weft winding means having a variable diameter for advancing the weft yarn at different rates at the same speed of rotation of the weft yarn feeder; and (b) a tension compensator disposed between said weft yarn feeder and the filling carrier, said tension compensator including a pair of weft guides for carrying the weft yarn along a substantially straight path therebetween, and slack takeup means disposed between said pair of weft guides and actuatable in synchronism with the operation of said weft yarn feeder for intermittently shifting sideways the weft yarn off said path, said slack takeup means comprising an eccentric plate cam having a peripheral groove for receiving the weft yarn therein, said cam being rotatable in a plane substantially parallel to said path, and said peripheral groove having a portion movable out of said path.

4. In a loom having a reciprocable filling carrier, a weft tensioning device comprising:

(a) a weft yarn feeder rotatable in synchronism with the reciprocation of the filling carrier for supplying a weft yarn to the filling carrier, said weft yarn feeder including weft winding means having a variable diameter for advancing the weft yarn at different rates at the same speed of rotation of the weft yarn feeder; and (b) a tension compensator disposed between said weft yarn feeder and the filling carrier, said tension compensator including a pair of weft guides for carrying the weft yarn along a substantially straight path therebetween and slack takeup means disposed between said pair of weft guides and actuatable in synchronism with the operation of said weft yarn feeder for intermittently shifting sideways the weft yarn off said path, said slack takeup means comprising a lever reciprocable in a direction substantially perpendicular to said path in response to the rotation of said weft yarn feeder, said lever having a pair of rolls for carrying the weft yarn therebetween, and said rolls being movable across and retractable from said path in response to the reciprocation of said lever.

5. A weft tensioning device comprising:

(a) a weft yarn feeder rotatable for supplying a weft yarn, said weft yarn feeder including weft winding means having a variable diameter for advancing the weft yarn at different rates at the same speed of rotation of the weft yarn feeder; and (b) a tension compensator for receiving the weft yarn fed by said weft yarn feeder and including a pair of weft guides for carrying the weft yarn along a substantially straight path therebetween, and slack takeup means disposed between said pair of weft guides and actuatable in synchronism with the operation of said weft yarn feeder for intermittently shifting sideways the weft yarn off said path, said slack tieup means comprising a pair of eccentric plate cams corotatable in planes substantially perpendicular to said path in response to the rotation of said weft yarn feeder, said cams having portions movable across and retractable from said path in response to the rotation of said cams, and a yarn guide fixedly disposed between said cams for carrying the weft yarn in said path.

6. A weft tensioning device according to claim 5, said slack takeup means including a yarn stop fixedly disposed between said cams for preventing the weft yarn from moving along with said portions of the cams.

7. A weft tensioning device comprising:

(a) a weft yarn feeder rotatable for supplying a weft yarn, said weft yarn feeder including weft winding means having a variable diameter for advancing the weft yarn at different rates at the same speed of rotation of the weft yarn feeder; and (b) a tension compensator for receiving the weft yarn fed by said weft yarn feeder and including a pair of weft guides for carrying the weft yarn along a substantially straight path therebetween, and slack takeup means disposed between said pair of weft guides and actuatable in synchronism with the operation of said weft yarn feeder for intermittently shifting sideways the weft yarn off said path said slack takeup means comprising an eccentric plate cam having a peripheral groove for receiving the weft yarn therein, said cam being rotatable in a plane substantially parallel to said path, and said peripheral groove having a portion movable out of said path.

8. A weft tensioning device comprising:

(a) a weft yarn feeder rotatable for supplying a weft yarn, said weft yarn feeder including weft winding means having a variable diameter for advancing the weft yarn at different rates at the same speed of rotation of the weft yarn feeder; and (b) a tension compensator for receiving the weft yarn fed by said weft yarn feeder and including a pair of weft guides for carrying the weft yarn along a substantially straight path therebetween, and slack takeup means disposed between said pair of weft guides and actuatable in synchronism with the operation of said weft yarn feeder for intermittently shifting sideways the weft yarn off said path, said slack takeup means comprising a lever reciprocable in a direction substantially perpendicular to said path in response to the rotation of said weft yarn feeder, said lever having a pair of rolls for carrying the weft yarn therebetween, and said rolls being movable across and retractable from said path in response to the reciprocation of said lever.

* * * * *